US007711459B2

(12) United States Patent
Rooney et al.

(10) Patent No.: US 7,711,459 B2
(45) Date of Patent: May 4, 2010

(54) METHOD AND APPARATUS FOR DETERMINING WAGON ORDER IN A TRAIN

(75) Inventors: John G. Rooney, Zurich (CH); Paolo Scotton, Horgen (CH)

(73) Assignee: International Business Machines Corporation, Armonk, NY (US)

( * ) Notice: Subject to any disclaimer, the term of this patent is extended or adjusted under 35 U.S.C. 154(b) by 163 days.

(21) Appl. No.: 12/099,242

(22) Filed: Apr. 8, 2008

(65) Prior Publication Data

US 2008/0269957 A1 Oct. 30, 2008

(30) Foreign Application Priority Data

Apr. 27, 2007 (EP) ..... 07107123

(51) Int. Cl.
*G05D 1/00* (2006.01)

(52) U.S. Cl. ..... 701/19

(58) Field of Classification Search ..... 701/1, 701/19, 29, 32, 35, 121, 207, 214; 340/988, 340/955.17, 996; 246/1 R, 2 R, 115, 117, 246/122 R, 124, 167 R, 187 A
See application file for complete search history.

(56) References Cited

U.S. PATENT DOCUMENTS 6,959,235 B1 * 10/2005 Abdel-Malek et al. ..... 701/33
2001/0044695 A1 * 11/2001 Doner ..... 701/213

* cited by examiner

*Primary Examiner*—Kim T Nguyen
(74) *Attorney, Agent, or Firm*—Gail H Zarick

(57) ABSTRACT

The present invention relates to a method and apparatus for determining the order of wagons in a train. The invention configures a plurality of wagons of a train to sense at least one environmental condition that the wagons are respectively exposed to when the train is moving. The invention configures the wagons to generate a corresponding announcement message in response to a change in state of the environmental condition. The invention configures the first wagon of the train to listen for the announcement message generated by any of the plurality of wagons. The invention configures the first wagon to compute a sequence of the announcement messages from an order in which the wagons have been heard.

20 Claims, 5 Drawing Sheets

METHOD AND APPARATUS FOR DETERMINING WAGON ORDER IN A TRAIN

CROSS-REFERENCE TO RELATED APPLICATIONS

This application claims priority under 35 U.S.C. §119 to European Patent Application No. 07107123.7 filed Apr. 27, 2007, the entire contents of which is incorporated herein by reference.

FIELD OF THE INVENTION

The present invention relates to a method, system, and computer program for detecting the order of wagons in a train. More specifically, the present invention determines if and how the order of wagons in a freight train is changed in a reliable manner.

BACKGROUND OF THE INVENTION

It is typically the case for passenger trains that all of the wagons of the train have the same origin and end destination. Even at the end destination, it is rarely the case that disassembling of the wagons, except for probably the end wagons, is done. In contrast, freight trains are better thought of as a temporary grouping of wagons coming from different origins and going to different end destinations. In accordance with the logistics planned for the cargo that they transport, freight trains are assembled and disassembled in locations called shunting yards. Thus, any given wagon may be part of different freight trains during its journey from its origin to its end destination.

In the shunting yards, the assembling of trains is done using appropriate algorithms such that all of the wagons in the train have the same next hop and that wagons with closer deadlines for their end destinations are put before those with longer ones. This scenario is, however, a simplification since also to be taken into account are factors such as, for example, the availability and the number of turning tables at the shunting yard, the space available for the disassembling/assembling and the time slots allocated for such purposes for any given train, etc. Currently, decisions on how to best satisfy all such conditions is made locally by staff at shunting yards. Thus, whilst a freight train may be assembled such that all the wagons of the train have the same next hop, it is usually not possible to compile them in accordance with the timetable of their respective end-destinations, i.e. that wagons with closer deadlines to their end destinations are placed before those with later ones may not be achieved.

When a freight train arrives in the next shunting yard, the structure of the train should be known before it is disassembled and before its associated wagons are assembled into other freight trains. A course of action for achieving this may be that the staff responsible for assembling the train record the order of its wagon compilation before the train leaves and transmit this information to the next shunting yard. However, this may not always be feasible since assembling of the trains is typically done in parallel and in an optimistic fashion with staff at the shunting yards applying local decisions as to the wagon order. A further reason why this is not done is because wagons may be added or removed outside of the shunting yard from and to the back of the train or even in the middle.

The problems associated to the manual assembling and disassembling of freight trains is further exacerbated by the fact that such trains are typically very long, for example, in the United States, freight trains may contain hundreds of wagons and may span over several kilometers.

Attempts have been made to use radio frequency identification (RFID) technology to identify wagons and thereby determine the composition of a train. However, problems due to RFID tags getting lost or deteriorated due to the extreme environmental conditions that the train may be exposed to during its journey has meant that these attempts have not always been successful.

Accordingly, it is a challenge to determine if and how the order of wagons in a train, particularly a freight train, is changed in a more reliable manner than is presently the case.

SUMMARY OF THE INVENTION

The illustrative embodiments of the present invention described herein provide a method, apparatus, and computer usable program product for detecting the order of wagons in a train. The embodiments described herein further provide if and how the order of wagons in a freight train is changed in a reliable manner.

An exemplary feature of an embodiment of the present invention is a method of determining the order of wagons in a train. An embodiment of the invention consists of a method for configuring a plurality of wagons of a train to sense at least one environmental condition that the wagons are respectively exposed to when the train is moving. The method further consists of configuring the wagons to generate a corresponding announcement message in response to a change in state of the environmental condition. The method further consists of configuring a first wagon of the train to listen for the announcement message generated by any of the plurality of wagons. The method further consists of configuring the first wagon to compute a sequence of the announcement messages from an order in which the wagons have been heard.

Another exemplary feature of an embodiment of the present invention is an apparatus for determining the order of wagons in a train. An embodiment of the invention consists of an apparatus with at least one sensor operable to sense at least one environmental condition that a wagon is exposed to when a train is moving. The apparatus further consists of at least one transmitter operable to generate an announcement message in response to a change in state of the environmental condition being sensed by the sensor. The apparatus further consists of at least one receiver operable to listen for the respective announcement messages generated by other wagons of the train. The apparatus further consists of at least one data-processor operable to compute a sequence of the announcement messages from an order in which they have been heard by the receiver.

Another exemplary feature of an embodiment of the present invention is a program storage device readable by a machine, tangibly embodying a program of instructions executable by the machine to perform method steps for determining the order of wagons in a train. The method consists of configuring a plurality of wagons of a train to sense at least one environmental condition that the wagons are respectively exposed to when the train is moving. The method further consists of configuring the wagons to generate a corresponding announcement message in response to a change in state of the environmental condition. The method further consists of configuring a first wagon of the train to listen for the announcement message generated by any of the plurality of wagons. The method further consists of configuring the first wagon to compute a sequence of the announcement messages from an order in which the wagons have been heard.

Various other features, exemplary features, and attendant advantages of the present disclosure will become more fully appreciated as the same becomes better understood when considered in conjunction with the accompanying drawings, in which like reference characters designate the same or similar parts throughout the several views.

BRIEF DESCRIPTION OF THE DRAWINGS

The figures form a part of the specification and are used to describe the embodiments of the invention and explain the principle of the invention together with the literal statement. The foregoing and other objects, aspects, and advantages will be better understood from the following non-limiting detailed description of preferred embodiments of the invention with reference to the drawings that include the following.

DETAILED DESCRIPTION OF THE PREFERRED EMBODIMENTS

Figure 1:
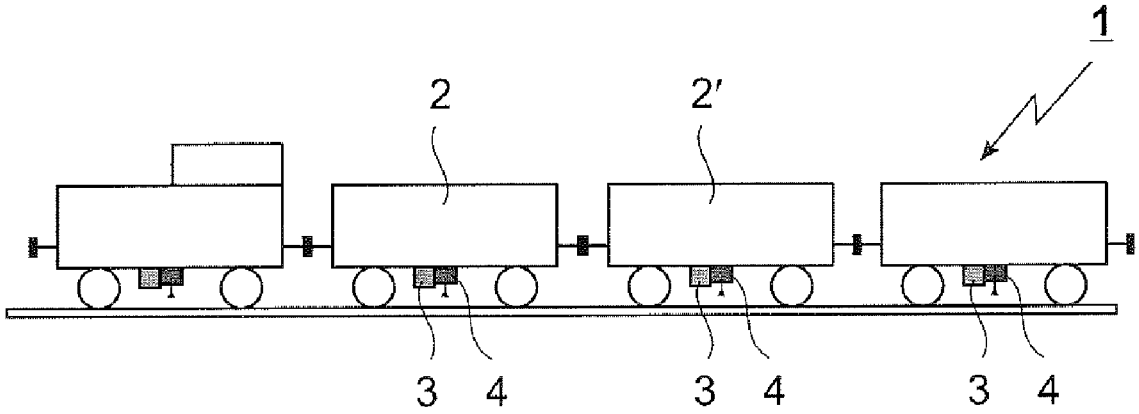
FIG. 1 is an illustration of a typical freight train.

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 1 is an illustration of a typical freight train 1 comprising a number of wagons 2 that are coupled to each other. In an embodiment of the present invention, a plurality of the wagons 2 of the train 1, which could be all or only some of the wagons 2 of the train 1, are each configured to perform a sensing step in which at least one environmental condition that such wagons 2 are respectively exposed to at a given location, when the train 1 is moving, is sensed. For example, the environmental condition that is sensed could be chosen to be: luminosity, inclination, sound/vibration, magnetic field orientation, variation of texture, etc. Of course, an embodiment of the present invention is not restricted to being based on sensing the listed environmental conditions and any other environmental condition or a combination of environmental conditions, which each wagon 2 is expected to experience when the train 1 is moving, may be used. So that power is consumed economically, the sensing step is performed intermittently.

To collect the sensory information, at least one sensor 3 is provided. The sensor 3 is operable to sense a change in state of an environmental condition. For example, such a change could be denoted by a change in: luminosity when the train enters a tunnel; orientation when the train changes direction; inclination when going up/down hill; sound/vibration when going over a junction; magnetic field orientation when passing something metallic; variation of texture when the train passes over a level crossing, etc.

Figure 2A:
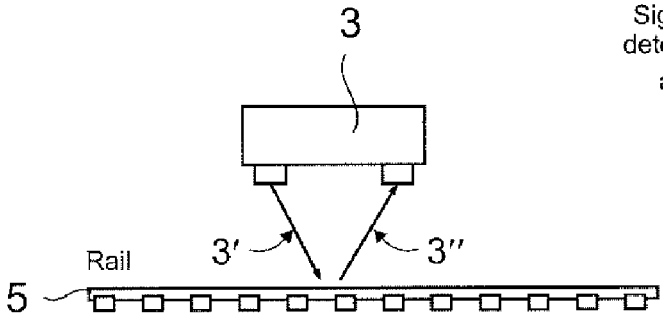
FIGS. 2*a* and 2*b* illustrate an example of sensing a change in state of an environmental condition in an embodiment of the present invention.

Reference is now made to FIG. 2*a*, which illustrates an example of sensing a change in state of an environmental condition that a wagon 2 of the train 1 is exposed to in an embodiment of the present invention. In the present example, the sensor 3 is operated to sense level crossings that the train 1 may travel over. This is done by using an infrared emitter 3' operated to emit infrared radiation and an infrared detector 3" that is arranged to detect any infrared radiation that is reflected off the surface 5 on which the train travels.

Figure 2B:
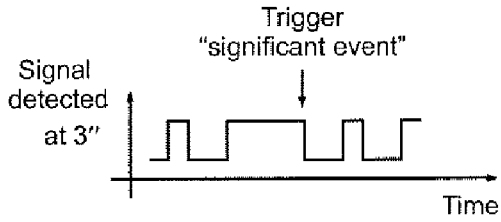

As can be seen from FIG. 2*b*, when the train 1 travels over a level crossing, the signal detected by the infrared detector 3" is of a longer duration compared to when the train 1 travels on the normal rail-track. The detection of such a signal denotes that a change in the environment in which the train is traveling, in this case the texture of the surface 5 over which the train 1 travels, has occurred. In an embodiment of the present invention, a wagon 2 that senses such an event is configured to broadcast this via a corresponding announcement message, which is generated in a state-change announcement step.

The announcement message can be generated in response to any change in state of the environmental condition being sensed, no matter how small the magnitude of the change. However, it is preferable that the announcement message is generated when a specific change of state in the environmental condition is sensed, which ultimately facilitates the order of the wagons to be determined in a more reliable manner. In this regard, an evaluation step is performed in an embodiment of the present invention in which the announcement message is generated only in response to the change in state of the environmental condition that is sensed being greater than a user-configurable threshold value. Such a change in state of the environmental condition is hereinafter referred to as a significant change in state of the sensed environmental condition. In this context and for the sake of example, the threshold value can be chosen to reflect the typically expected change in light intensity when the train enters/leaves a tunnel. For such an event, it can be deduced that the change in light intensity that the train would be exposed to would be expected to be larger than compared to when the train travels under a bridge and so would facilitate determining the order of the wagons with increased reliability and improved power consumption efficiency.

The announcement message is typically a radio signal comprising information on the identity of the wagon 2 from which the announcement message has been generated. In an embodiment of the present invention, any wagon 2' of the train 1 can be configured to perform an event-pending step in which the wagon 2' listens for announcement messages generated by any of the plurality of wagons 2—hereinafter, such a wagon is referred to as the first wagon 2'. In response to hearing announcement messages, the first wagon 2' is configured to perform a message-processing step in which a sequence of the announcement messages is computed from the order in which they have been heard. From the sequence of the announcement messages, the order of the plurality of wagons 2 can be deduced. The first wagon 2' transmits the sequence computed in the message-processing step to at least one data collection point in a sequence-transmission step. In this case, the data collection point may be the next destination of the train 1 where information on the order of the train 1 may be used in its reconfiguration. The data collection point may even be one or more of the wagons 2 of the train 1—by combining the sequences received at the different wagons 2, the overall profile of the train can be deduced. To be noted is that the terminology first wagon 2' has only been used to distinguish that wagon from other wagons 2. The present invention is not limited to this wagon being the first in the line of wagons; it can be anywhere along the length of the train, i.e. in its front, middle or end.

In an embodiment of the present invention, the first wagon 2' may be one of the plurality of wagons 2, i.e. it is also configured to perform sensing of the environmental condition. In this case, it may furthermore be configured to perform a state-change determination step in which the first wagon 2' can track when it has sensed substantially the same change in state of the environmental condition as any of the plurality of wagons 2 relative to those wagons 2. This may, for example, be implemented by the first wagon 2' being configured to time, when it senses the same significant state change in the environmental condition as any of the plurality of wagons 2, relative to when it hears the announcement messages generated by those wagons 2. Whether or not substantially the same significant change in state has been sensed by the first wagon 2' is ascertained from a characteristic of the sensed event, for example, its intensity. This will be described in more detail herebelow. From the speed of the train 1, which is deducible from, for example, the locomotive broadcasting this value and the timing information ascertained in the above-described manner, the distance between the first wagon 2' and any of the plurality of wagons 2 may be calculated. In this way and assuming that the size of the wagons 2 in the train 1 is substantially the same, the number of intermediate wagons between the first wagon 2' and any one of the plurality of wagons 2 can be determined. From the information on the intermediate wagons, it may also be determined if the configuration of any of the intermediate wagons to perform an embodiment of the present invention as above-described with respect to sensing an environmental condition and a state change thereof, for example, has failed. Thus, the present invention is applicable to determining the order and number of wagons 2 in a part of the train 1.

In an embodiment of the present invention, the first wagon 2' is configured to perform an updating step in which it periodically listens for new announcement messages from any of the plurality of wagons 2 regarding a significant change in state of an environment condition that they are configured to sense. Any new announcement messages that are heard are used to keep the wagon order information updated. The new announcement messages may be based on a further change in state of the environmental condition that is sensed, for example, the change in luminosity when the train 1 leaves a tunnel whereas previous announcement messages heard by the first wagon 2' would be based on the change in luminosity from light to dark due to the train 1 entering the tunnel.

In an embodiment of the present invention, an announcement message is typically a radio signal comprising information on an identity of a wagon that generated the announcement message. The announcement message may comprise further supplementary information such as an event identifier, which is a user-chosen arbitrary number that identifies the change in state that the sensor 3 associated with a wagon 2 is configured to sense, and a characteristic of the sensed event. For the sake of example, the event identifier allocated to sensing a change in luminosity from light to dark when the train 1 enters a tunnel may be allocated the absolute and arbitrary value 13 whilst that allocated for the change in luminosity from dark to light when the train 1 emerges from the tunnel may be chosen to be the arbitrary value 14. The degree of change in luminosity that is sensed for each of these events forms the basis of the aforesaid characteristic of the event.

In an embodiment of the present invention, an announcement message is typically transmitted over a predetermined frequency channel that is chosen such that the possibility of interference with wireless communication in other trains which may, for example, be within a short range, is reduced. However, allocation of the predetermined frequency channel is typically done in a random manner, which may yet still introduce the possibility for the above-described interference to occur. In order to reduce this possibility, the announcement messages generated by wagons 2 in the train 1 are each tagged with a unique group identifier, which is used to distinguish the signals that may be heard from other trains.

Although randomly chosen, the predetermined frequency channel is chosen to be different from a frequency channel used for communication when the train is stationary on account of the latter channel typically being used in a shunting yard to facilitate communication with other wagons that are to be coupled together, for example.

For the implementation of an embodiment of the present invention, a mote 4 may be used such as, for example, the Berkeley MicaZ mote. This particular platform is equipped with an 8 MHz, 8 bit processor with 4 kbytes of RAM and 128 kbytes of ROM. It has a 40 kb/s radio interface through which the mote is able to transmit and receive radio signals and comes with a range of pluggable environmental sensors 3. By way of example and as can be most clearly seen from FIG. 1, the mote 4 is connected to the underside of a wagon 2 in an embodiment of the invention. The present invention is, of course, not limited to the mote 4 being attached to the underside of the wagon 2 but can be coupled to the wagon 2 in any other position from where sensing an environmental condition and/or communication with other wagons is possible.

With reference being made to FIG. 1, the sensor 3 is configured to perform the sensing step in which it periodically senses for some change in the environment that the train 1 is subjected to during its journey. The time between sensing is configurable but is preferably set to some hundreds of milliseconds. This is based on the fact that, for a train moving at a typical speed of 100 km/h, about 2 meters is covered in 100 milliseconds. This distance is expected to be greater than the distance between two motes 4 in different wagons 2.

When a significant change is sensed by the environmental sensor 3, an announcement message is generated by the mote 4 in a state-change announcement step and transmitted over its radio interface with an indication of the degree of change of the environmental condition that has been sensed. For example, the event sensed for could be the entry into a tunnel and the characteristic of this event that is measured is the change in light intensity. Upon entry into the tunnel, the reduction in light intensity is sensed by the sensor 3 and a measure of the delta is incorporated into an announcement message that is generated by the corresponding mote 4 and broadcasted over the radio interface along with the identifier for the wagon 2.

In an embodiment of the present invention, the first mote 4 to broadcast the sensing of a significant change in an environmental condition is considered to be first in the line of wagons 2 of the train 1—in this case, the mote 4 allocates a unique event identifier to the announcement message generated in response to the significant change being sensed before transmitting it. From the point of view of a given mote 4, the order in which it receives announcement messages about the sensed event from any of the motes 4 associated to the other wagons 2 of the train, when it enters a listening mode during an event-pending step, determines the order of the wagons 2. In a message-processing step, the mote 4 uses its data-processing capability to compute the sequence of the wagons 2 in the train 1 from the order of the announcement messages that it has heard when in the listening mode.

Typically, the mote 4 has a radio range of about 100 meters meaning that a given wagon 2 cannot communicate with all others, but by building up a partial description of the order as hereinabove described and periodically exchanging it with neighbors, all motes 4 on the train 1 can learn of the entire end-to-end order of wagons 2. To facilitate this, the mote 4 transmits, in a sequence transmission step, the sequence of wagons 2 that it has computed from the announcement messages that it has heard to at least one data collection point. As discussed before, the data collection point could be the next destination of the train or any of the other wagons of the train.

In an embodiment of the present invention, the mote 4 is configured to periodically listen for new announcement messages generated from motes 4 on any of the other of wagons 2 regarding a significant change in state of an environment condition that has been sensed. Any new announcement messages that are heard are used to keep the wagon order information updated.

Although not shown in the drawings, in an embodiment of the present invention, the mote 4 comprises a state-change determinator that is configured to perform the state-change determination step described hereinabove. In this way, the number of intermediate motes 4 between two given motes 4 may be determined. From this information, it may also be determined if any of the intermediate motes has failed and/or faulty.

An embodiment of the present invention is applicable to a variety of different scenarios of which one is considered hereinafter. It is assumed that, in addition to the above-described features, the train 1 is equipped with long-range wireless communication, for example, general packet radio service (GPRS) or wideband code-division multiple access (W-CDMA). Each of the wagons 2 is equipped with a mote 4 and each of the motes 4 send and receives on the same frequency F1, which is used to facilitate communication between wagons that are to be coupled together in the shunting yard. When the train 1 is assembled and leaves the shunting yard, an instruction is sent down the train 1 to use another frequency F2 to avoid interference with other trains with which this train may come into contact with between arrivals at the next shunting yard. Frequency F2 is chosen randomly from the set of frequencies available to the motes 4 in the train 1. For example, there are 40 such frequencies on a Berkeley MicaZ mote. As the frequency F2 is randomly chosen, there is still some possibility of interference with other trains. To reduce this, a unique group-identifier is given to all communications within the train 1 during the journey. Although, the train 1 may hear broadcasts from another train on the same frequency F2, it will recognize them as being foreign on account of having a different or no group-identifier and silently drop them.

The order of the train 1 is determined in the way previously described before arriving in the destination shunting yard. A message may be sent over the long range wireless communication informing the shunting yard of the order of the arriving train. On arriving in the yard, any of the motes 4 can be connected to a simple hand-held device equipped with a similar radio to that on the mote 4 to extract the information on the wagon order. Before disassembling the train 1, the frequency F2 that the motes 4 listen on is switched back to F1 so that reassembling with wagons from other trains can be done.

Figure 3:
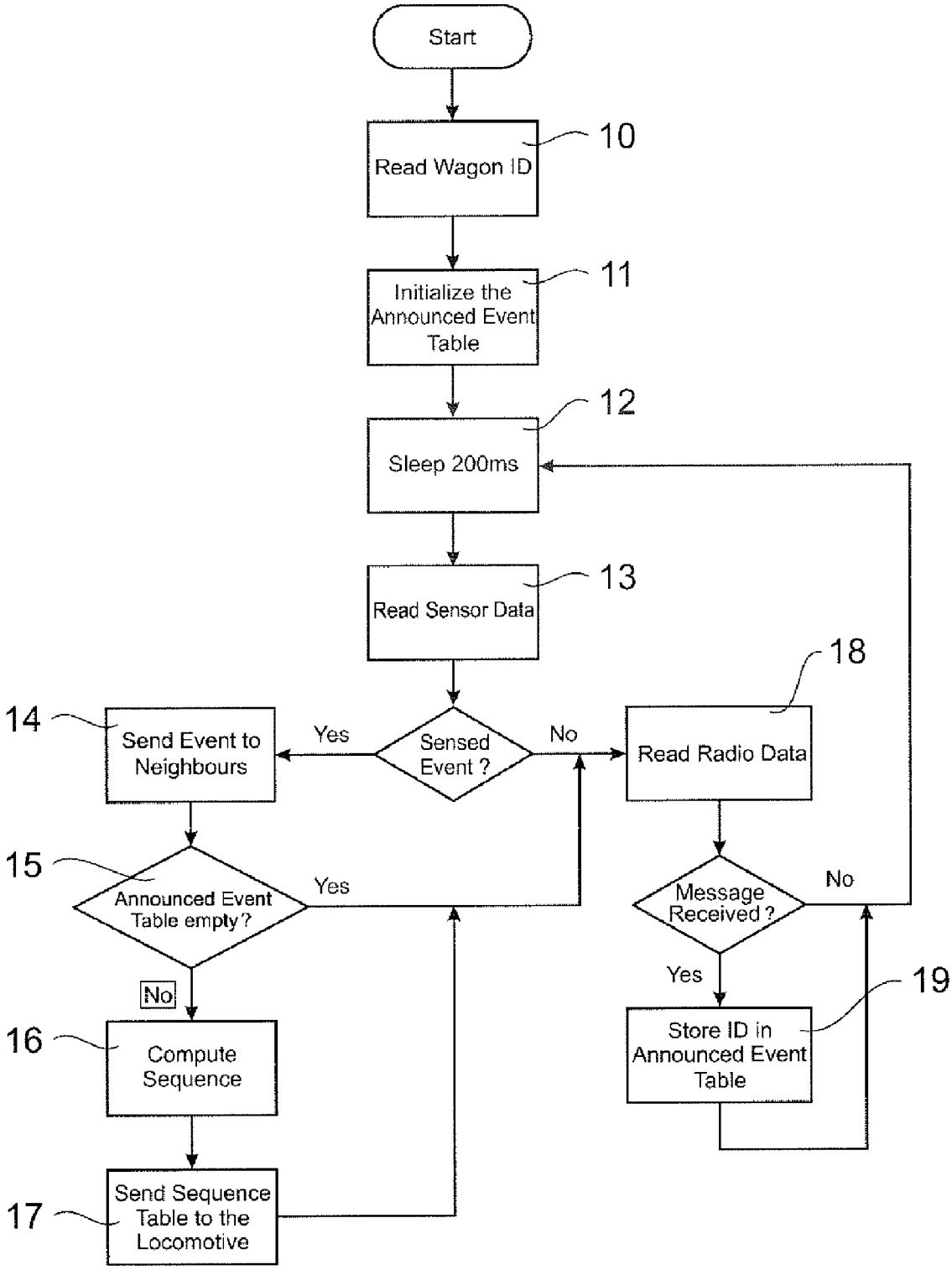
FIG. 3 schematically illustrates an embodiment of the present invention.

Reference is now made to FIG. 3, which schematically illustrates an embodiment of the present invention. As can be seen from FIG. 3, in a wagon identification step 10, the mote 4 identifies the wagon 2 that it is coupled to by reading the wagon identifier of that wagon 2. In an initialization step 11, the mote 4 initializes an announcement event table where entries of announcement messages from other wagons 2 that a significant change in state of an environmental condition has been sensed are made when they are heard by the mote 4. In a sleep mode step 12, the mote 4 enters a sleep mode, the time-duration of which is configurable and which is set to occur every 200 milliseconds in the present example. In a sensor-data read step 13, the mote 4 is configured to determine whether a corresponding sensor 3 has recorded a significant change in state of an environmental condition that it is configured at the outset to sense. In response to such an event having been sensed, in a state-change announcement step 14, a corresponding announcement message is generated and broadcasted to any of the other wagons 2 in the train that are configured to receive such a message. In an announcement event table scan step 15, it is determined whether the announcement table contains any entries of announcement messages received from any of the other wagons 2. In response to the announcement table containing some entries, their sequence is computed by the mote 4 in a message-processing step 16 from the wagon identification information contained in the announcement messages. The message-processing step 16 also updates the sequence with the announcement message generated in the state-change announcement step 14. In a sequence-transmission step 17, the mote 4 transmits the sequence to at least one data collection point, which includes the next destination of the train and/or other wagons 2 of the train 1.

In response to the discovery that the announcement table is empty in the announcement event table scan step 15, the mote 4 is routed to performing an event-pending step 18 in which it is operated to listen for any announcement message broadcasts made by other wagons 2 of the train 1. Incidentally, the event-pending step 18 is also performed in response to no sensory information having been obtained in the sensor-data read step 13; it is also performed to update the sequence computed in the sequence-transmission step 17, with announcement messages generated by subsequent motes further down the length of the train, by the mote 4 being routed accordingly.

In response to the discovery that no announcement messages have been heard in the event-pending step 18, the mote 4 is routed to performing the sleep mode step 12 and the steps subsequent thereto as described above. In response to announcement message broadcasts having been heard in the event-pending step 18, then the announcement table is updated accordingly in a step 19 after which the mote 4 is routed to entering the sleep mode.

An advantage associated to the above-described implementation is that the event-pending step 18 in which the mote 4 enters a listening mode for hearing any announcement message broadcasts is done within the time-period allocated for the sensor 3 corresponding to the mote 4 performing its sensory function. In this way, information on the wagon order of the train 1 may be collected in a time and power efficient manner.

Figure 4:
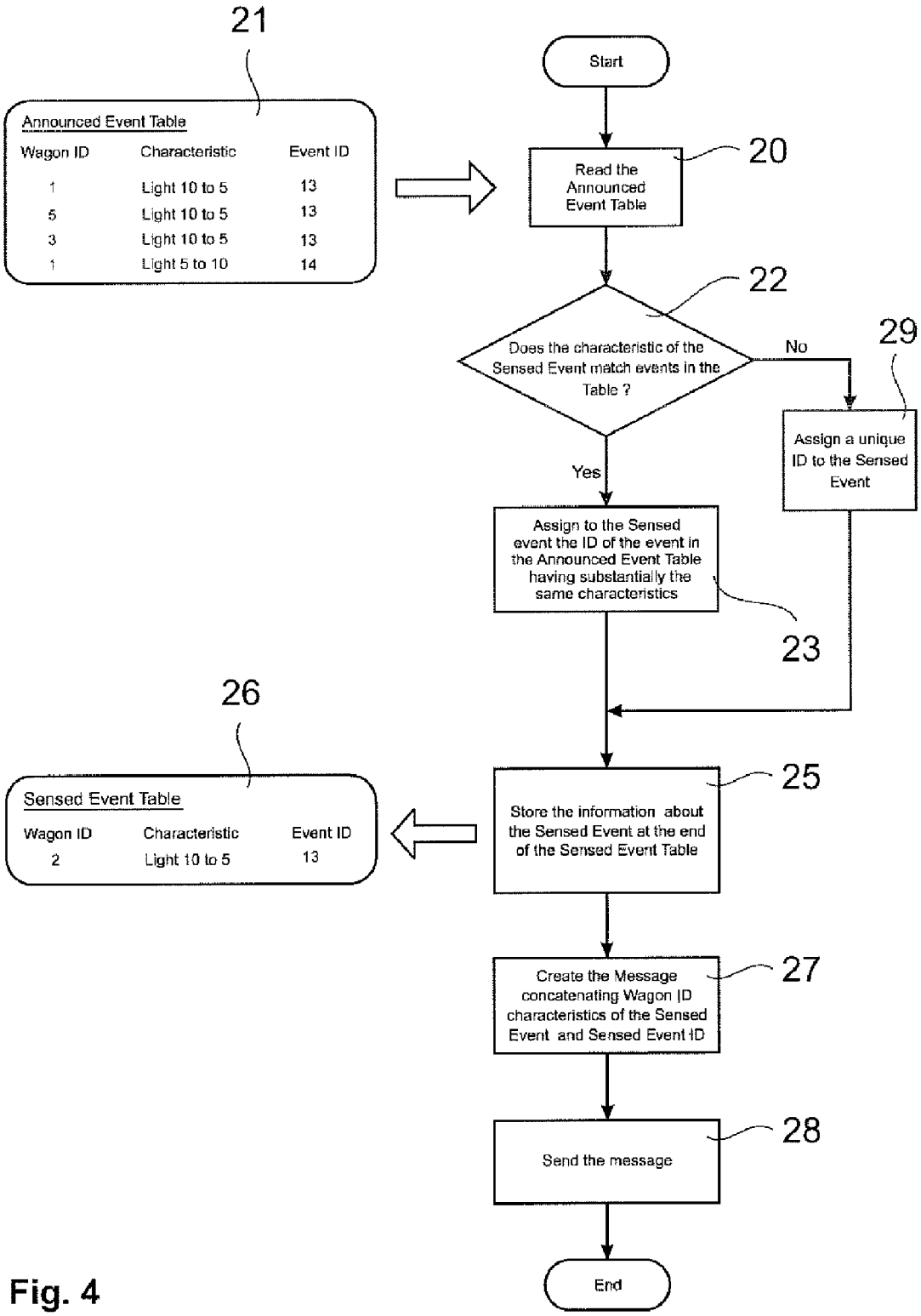
FIG. 4 schematically illustrates how an announcement message is prepared for broadcasting in an embodiment of the present invention.

Reference is now made to FIG. 4, which schematically illustrates how an announcement message is prepared for broadcasting to other wagons 2 in the train 1. As can be seen from FIG. 4, in the announcement event table read step 20, the entries in the announcement event table 21 of a given wagon 2 are read. An announcement message entry in the announcement event table 21 comprises information on the wagon identifier from which the announcement message was generated. It also contains information on the sensed event by way of the unique event identifier assigned thereto and the characteristic of the condition that was sensed. In the present example, the characteristic of the condition that is sensed is the change in light intensity when a wagon enters and emerges from a tunnel, this being respectively denoted by arbitrary numbers corresponding to the raw data measured for these events as recorded in the "characteristic" entries as "light 10 to 5" and "light 5 to 10". As discussed before, the unique event identifiers corresponding and allocated to these sensed conditions are arbitrary, user-chosen numbers. In the present example, the event identifier 13 has been chosen to denote a reduction in the sensed light intensity, and 14, for denoting an increase in the sensed light intensity.

In a comparison step 22, a comparison is performed between the characteristic(s) of an environmental condition sensed by the wagon and the corresponding entries in the announcement event table 21. In response to it being determined that the environmental condition sensed by that wagon has substantially the same characteristics as some of the entries in the announcement event table, the same event identifier as those entries is allocated to the sensed event as denoted by the assignment step 23. Information on the sensed event updated in this manner is then stored in a sensed-event table 26 in a step 25. So in the present example, since a reduction in light intensity from 10 to 5 has also been sensed by the wagon having a wagon identifier 2, the corresponding information on this wagon in the sensed-event table 26 is tagged with the event identifier 13. In order to update the announcement event table 21 of the other wagons 2, an announcement message is prepared for broadcasting in step 27 wherein information on the wagon identifier, characteristic of the sensed event and its event identifier is concatenated. So, in the present example, the announcement message prepared in step 27 corresponds to that with which the sequence event table 26 has been most recently updated. In a step 28, this announcement message is broadcasted to any of the other wagons of the train that are configured to receive such messages.

If, in the comparison step 22, it is found that the characteristic of the event sensed by the wagon is not shared by any of the announcement messages recorded in the announcement event table 21 of that wagon, then this is indicative of the fact that the wagon is the first in the line of wagons and is, by this virtue, the first out of all the wagons to perform the environmental sensing. In this regard, the event identifier allocated to the sensing of this event is set in event identifier allocation step 29 to be used for subsequent announcement messages from the other wagons of the train when they sense the same condition.

Figure 5:
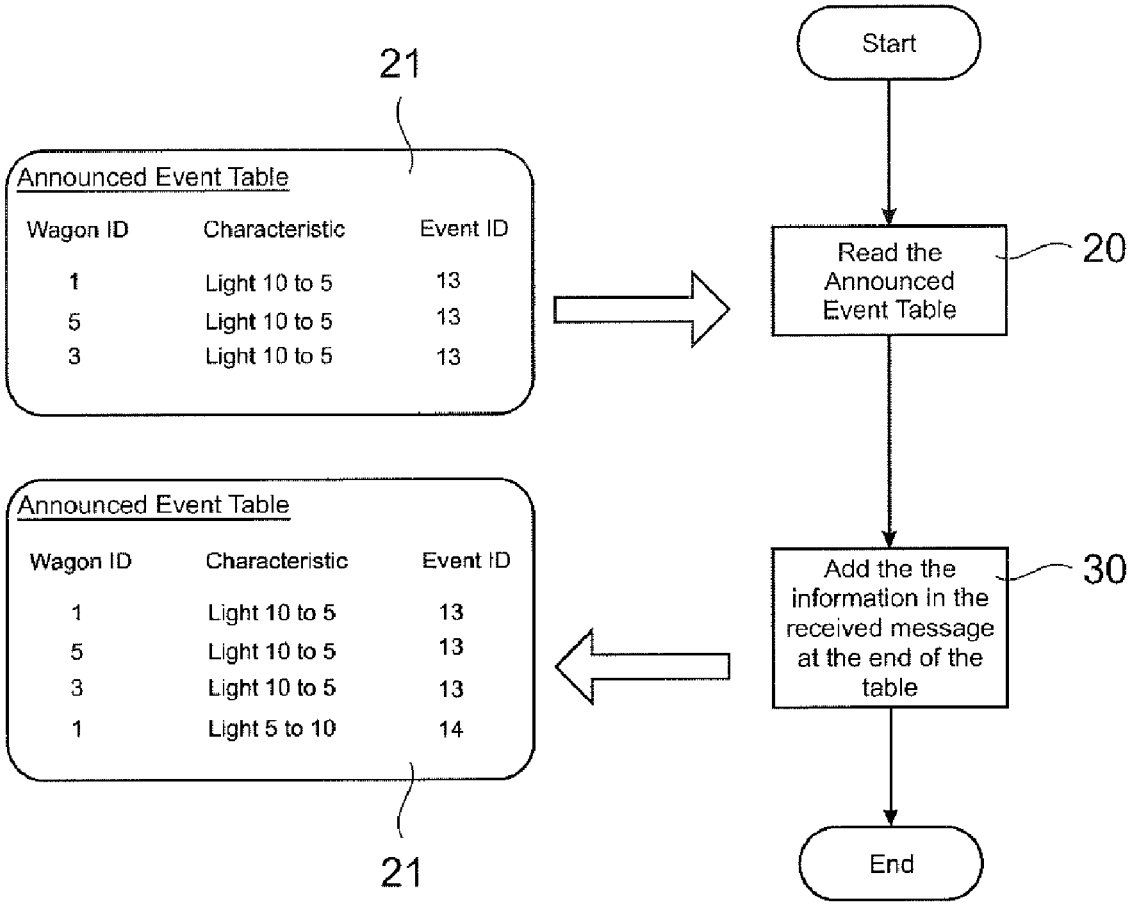
FIG. 5 schematically illustrates how the announcement event table 21 is kept updated in an embodiment of the present invention.

Reference is now made to FIG. 5, which schematically illustrates how the announcement event table 21 is kept updated in an embodiment of the present invention. This is done by the event-pending step 18, which was described with reference to FIG. 3, being performed periodically by the mote 4 corresponding to the wagon. In response to any new broadcast messages being heard, this information is entered at the end of the announcement event table 21 as denoted by step 30. For example, the most current announcement message heard in the event pending step 18 pertains to the first wagon in the line of wagons sensing an increase in light intensity due to the train emerging from a tunnel. It can be seen that, since this characteristic of the sensed event is different from previously-heard announcement messages in the announcement event table 20, a different event identifier 14 has been allocated to this event.

Figure 6:
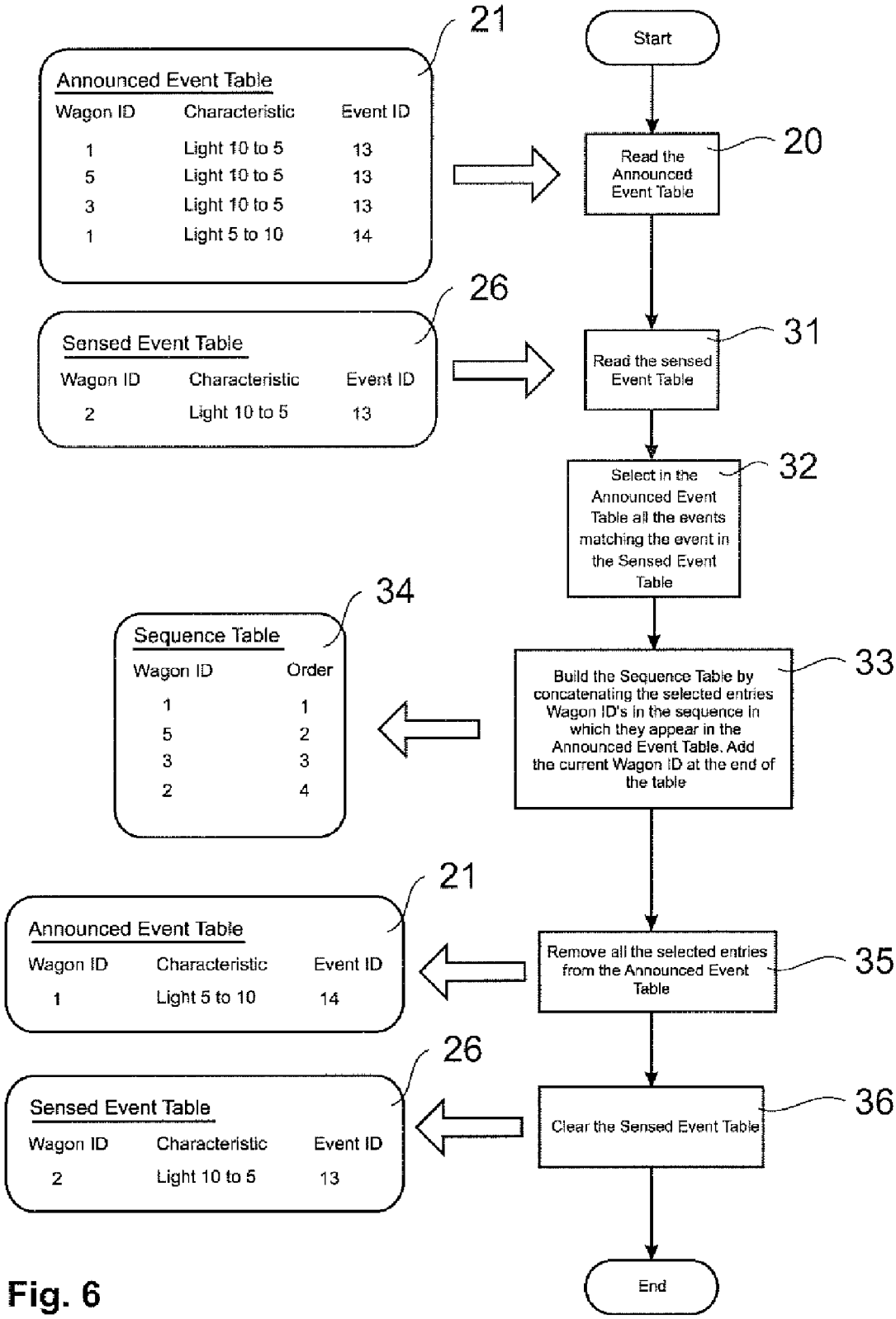
FIG. 6 schematically illustrates how the sequence of announcement messages is computed in an embodiment of the present invention.

Reference is now made to FIG. 6, which schematically illustrates how the sequence of announcement messages is computed in an embodiment of the present invention. As described above with reference to FIG. 4, in the announcement event table read step 20, the announcement event table 21 stored in the mote 4 of a given wagon is accessed and read. In this case and for the sake of example, the wagon is one that has most recently performed a sensing event and will be referred to as the current wagon to distinguish it from the others. As described with reference to FIG. 5, the announcement event table 21 is kept updated with newly-heard announcement messages. In the sensed-event table read step 31, the sensed-event table 26 is read to determine the event sensed by the current wagon. In response to a match being found between entries in the announcement event table 21 and the sequence-event table 26 regarding a sensed event, then those entries in the announcement event table 21 are selected in an event-selection step 32. In a sequence table construction step 33, the wagon identifiers of the sequence entries selected in the event-selection step 32 are concatenated in the order in which they appear in the announcement event table 21, since this reflects the sequence in which they were heard by the current wagon. In this step, the wagon identifier of the current wagon is also added after the selected entries. In this way, the sequence table 34 is constructed and transmitted to at least one data-collection point in the sequence transmission step 17. Subsequently, in a step 35, the announcement event table 21 is refreshed by removing all the entries selected in the event-selection step 32. Similarly, the sensed-event table 26 is also cleared in a step 36.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadcast interpretation so as to encompass all such modifications and equivalent structures and functions.

What is claimed is:

1. A method for determining the order of wagons in a train, said method comprising:

configuring a plurality of wagons of a train to sense at least one environmental condition that said wagons are respectively exposed to when said train is moving;

configuring said wagons to generate a corresponding announcement message in response to a change in state of said environmental condition;

configuring a first wagon of said train to listen for said announcement message generated by any of said plurality of wagons; and configuring said first wagon to compute a sequence of said announcement messages from an order in which said wagons have been heard.

2. The method of claim 1, further comprising:

configuring said first wagon to track when said first wagon has sensed substantially the same change in state of said environmental condition relative to any of said plurality of wagons.

3. The method of claim 2 further comprising:

generating said announcement message in response to said sensed change in state of said environmental condition being greater than a user-configurable threshold value.

4. The method of claim 2, further comprising:

configuring said first wagon to transmit the sequence to at least one data collection point.

5. The method of claim 2, further comprising:

configuring said first wagon to perform said listening for a respective announcement message generated by any of said plurality of wagons periodically; and updating the sequence with newly-heard announcement messages.

6. The method of claim 2, further comprising:

at least a wagon identifier of said wagon to generate said announcement message.

7. The method of claim 2, further comprising:

tagging said announcement messages with a unique group identifier.

8. The method of claim 1 further comprising:

generating said announcement message in response to said sensed change in state of said environmental condition being greater than a user-configurable threshold value.

9. The method of claim 1, further comprising:

configuring said first wagon to transmit the sequence to at least one data collection point.

10. The method of claim 1, further comprising:

configuring said first wagon to perform said listening for a respective announcement message generated by any of said plurality of wagons periodically; and updating the sequence with newly-heard announcement messages.

11. The method of claim 1, further comprising:

at least a wagon identifier of said wagon to generate said announcement message.

12. The method of claim 1, further comprising:

tagging said announcement messages with a unique group identifier.

13. The method of claim 1, further comprising:

broadcasting said announcement message on a frequency channel different from a frequency channel used for communication when said train is stationary.

14. The method of claim 1, wherein said environmental condition is selected from the group consisting of luminosity, orientation, inclination change, sound, vibration, magnetic field alteration and variation of texture.

15. The method of claim 1, wherein said configuring of said plurality of wagons of said train to sense at least one environmental condition said wagons are respectively exposed to when said train is moving is performed intermittently.

16. The method of claim 1, further comprising:

configuring any of said plurality of wagons to periodically sense at least one environmental condition said wagons are respectively exposed to when said train is moving at least every 100 milliseconds.

17. An apparatus for determining the order of wagons in a train, said apparatus comprising:

at least one sensor operable to sense at least one environmental condition that each of at least a first wagon and a second wagon are exposed to when a train is moving;

at least one transmitter operable to generate an announcement message in response to a change in a state of said environmental condition being sensed by said sensor;

at least one receiver operable to listen for said respective announcement messages generated with respect to said first wagon and said second wagon of said train; and at least one data-processor operable to compute a sequence of said announcement messages from an order in which said announcement messages have been heard by said receiver.

18. The apparatus of claim 17, further comprising:

a state-change determinator operable to track when substantially the same change in said state of said environmental condition has been sensed relative to any of other said wagons of said train.

19. The apparatus of claim 17, further comprising:

a mote coupled to at least one of said first wagon and second wagon.

20. A program storage device readable by a machine, tangibly embodying a program of instructions executable by the machine to perform method steps for determining the order of wagons in a train, the method comprising the steps of:

configuring a plurality of wagons of a train to sense at least one environmental condition that said wagons are respectively exposed to when said train is moving;

configuring said wagons to generate a corresponding announcement message in response to a change in state of said environmental condition;

configuring a first wagon of said train to listen for said announcement message generated by any of said plurality of wagons; and configuring said first wagon to compute a sequence of said announcement messages from an order in which said wagons have been heard.

* * * * *